US005605452A

United States Patent [19]

Robertson et al.

[11] Patent Number: 5,605,452

[45] Date of Patent: Feb. 25, 1997

[54] METHOD AND APPARATUS FOR CONTROLLING STAGED COMBUSTION SYSTEMS

[75] Inventors: Thomas F. Robertson, Cleveland; John L. Homa, Highland Heights, both of Ohio

[73] Assignee: North American Manufacturing Company, Cleveland, Ohio

[21] Appl. No.: 469,220

[22] Filed: Jun. 6, 1995

[51] Int. Cl.[6] ..... F23C 5/00

[52] U.S. Cl. ..... 431/8; 431/10; 431/76; 431/90; 60/39.27; 60/733

[58] Field of Search ..... 431/8, 10, 12, 431/76, 89, 90; 60/39.27, 39.06, 733, 746

[56] References Cited

U.S. PATENT DOCUMENTS

| | | | |
|---|---|---|---|
| 3,159,345 | 12/1964 | Osburn et al. | 431/90 |
| 3,734,675 | 5/1973 | Osburn . | |
| 3,814,570 | 6/1974 | Guigues et al. . | |
| 3,861,855 | 1/1975 | Seider . | |
| 4,029,061 | 6/1977 | Asano . | |
| 4,111,637 | 9/1978 | Hilman, II . | |
| 4,421,473 | 12/1983 | Londerville . | |
| 4,449,918 | 5/1984 | Spahr . | |
| 4,474,121 | 10/1984 | Lewis | 431/76 |
| 4,568,266 | 2/1986 | Bonne . | |
| 4,576,570 | 3/1986 | Adams et al. | 431/12 |
| 4,588,372 | 5/1986 | Torborg . | |
| 4,645,540 | 2/1987 | West . | |
| 4,653,998 | 3/1987 | Sohma et al. . | |
| 4,798,531 | 1/1989 | Breckner | 431/90 |
| 4,927,351 | 5/1990 | Hagar et al. | 431/90 |
| 5,263,850 | 11/1993 | Walker . | |
| 5,327,718 | 7/1994 | Iwata et al. | 60/39.27 |

*Primary Examiner*—Carroll B. Dority
*Attorney, Agent, or Firm*—Jones, Day, Reavis & Pogue

[57] ABSTRACT

A method and apparatus is disclosed for controlling staged combustion systems of the type used for combusting two reactants wherein at least one reactant is supplied as two flows, the first of which is combusted with the flow of the other reactant in a primary stage and the other of which is combusted with the exhaust of the primary stage in a secondary stage. In the present invention, the respective flows are monitored and controlled to provide a desired equivalence ratio for both the first stage and for the burner overall which is adaptable in response to variable input conditions. By controlling the flows in this way, a calculated energy output or adiabatic flame temperature can be produced. The present invention can also control the reactant flows to each stage in response to measured parameters such as flame temperature or emission levels. In this way, the flows can be varied in order to drive the measured parameters to a desired level.

18 Claims, 3 Drawing Sheets

METHOD AND APPARATUS FOR CONTROLLING STAGED COMBUSTION SYSTEMS

BACKGROUND OF THE INVENTION

The present invention is directed to the field of staged combustion systems. Such combustion systems supply two reactants, typically fuel and air, to a burner to be combusted. In a staged burner, a first reactant is supplied in two flow streams, a primary flow and a secondary flow. The primary flow of the first reactant is combusted with the entirety of a second reactant in a primary combustion stage. The secondary flow of the primary reactant is combusted with the burnt effluent of the primary stage in a secondary combustion stage. Either fuel or oxidant can be supplied as the primary reactant. Specifically, a staged burner can be either air-staged or fuel-staged.

A typical previous fuel-staged combustion system 10 is shown in FIG. 1. Of course, those skilled in the art would appreciate that this system could also be configured as an air-staged system. In this previous system 10, an air flow 12 is supplied using a blower 14. A metering orifice plate 16 is used to create a pressure differential which defines a desired air flow rate. The fuel is supplied from a common supply 18 with a metering orifice plate 20 used to create a pressure differential which defines a desired fuel flow rate.

In the fuel-staged system shown, the common supply 18 is divided into a primary fuel flow 22 and a secondary flow 24. The primary fuel flow 22 is combusted with the air flow 12 in the primary combustion stage 26. The secondary flow 24 is combusted with the burnt effluent of the primary stage 26 in the secondary combustion stage 28, which is typically a furnace environment. The rate of the primary flow 22 is defined by a limiting orifice 30 which is adjusted to provide a desired flow to the primary stage 26. Similarly, the rate of the secondary flow 24 is defined by another limiting orifice 32 which is adjusted to provide a desired flow to the secondary stage 26. In this way the split between the two stages is controlled.

The flow rates to the primary and secondary stages are defined by the limiting orifices 30, 32 in order to provide a desired equivalence ratio $\phi$ to the primary stage 26 and the burner 10 overall. The equivalence ratio $\phi$ is related to the fuel-to-air ratio and measures the proportion of fuel to the proportion of air in a combustion reaction. The equivalence ratio is given by the following relationship:

$$\phi = \frac{F\,(A/F)\text{stoic.}}{A} = \frac{(F/A)\text{actual}}{(F/A)\text{stoic.}}$$

where F and A respectively signify proportional reactive volumes of fuel and air. Stoichiometric burner operation is defined as $\phi=1$, where fuel and air are supplied in a proportion to produce a complete combustion reaction. For $\phi>1$, the burner fires rich, i.e. with excess fuel. With rich firing, the fuel is not completely combusted with the available supplied air. For $\phi<1$, the burner fires lean, i.e. with an excess of air. With lean firing, the excess air contributes to the thermal load, diluting the heat released by combustion.

Stoichiometric firing ($\phi=1$) is theoretically the most efficient burner operation since, at this ratio, the maximum heat is released by the combustion reaction. However, stoichiometric firing is difficult to maintain. Also carbon monoxide production increases near stoichiometric firing. As a practical matter, burners are typically fired slightly lean, at about 10% excess air ($\phi=0.909$), an equivalence ratio which offers a good balance between efficiency and carbon monoxide production. Burners are staged to provide a desired combustion result and a equivalence ratio $\phi$ for the primary zone is selected such that an optimum performance by the combustion system is achieved.

In a fuel-staged system such as illustrated in FIG. 1, the primary fuel flow 22 is supplied so as to run lean in the primary stage 26, i.e. with an equivalence ratio $\phi$ less than 1. The additional fuel is supplied at the secondary stage 28 in order to consume the remaining air, thereby raising the overall burner equivalence ratio $\phi$ to about 0.909, approaching a practical efficient level of combustion. In another example, an air-staged system has a primary air flow configured so that the primary stage runs rich, i.e. with an equivalence ratio $\phi$ greater than one. With such stoichiometry, the reaction in the primary stage is incomplete. Secondary air is supplied in the secondary stage in order to complete the reaction, reducing the overall burner equivalence ratio to about 0.909.

Staged burners have several advantages over conventional single-stage burners. By combusting the fuel in two stages, flame temperature can be carefully controlled, diminishing the production of nitrogen oxide compounds (Nox), the levels of which are carefully monitored by government regulatory agencies. By extending combustion over two stages, the thermal peaks that produce NOx are moderated.

As with other types of burners, staged burners are varied from high fire to low fire in order to effect turndown. The previous burner of FIG. 1 includes a common mass flow ratio control system. The thermal demand of the system is linked to the flow of an independent reactant, which can be either the primary or secondary reactant. As thermal demand increases, the flow of the independent reactant is increased. The ratio control system varies the flow of the remaining dependent reactant, maintaining the respective reactant flows in the proper proportion. The ratio control system includes a control unit 38 which operates a motorized valve 34 for varying the flow of the common fuel supply 18. Similarly, air flow 12 is also varied using a motorized valve 36 controlled by the control unit 38. The primary and secondary flows 22, 24 are fixed by the respective limiting orifices 30, 32. Thus, the primary and secondary flows are supplied at rates which are in a fixed proportion to each other as flow is varied between high fire and low fire. This fixed proportion creates several problems in burner operation.

FIG. 2A illustrates the change in $\phi$ as a function of burner input during thermal turndown for a typical premixed air-staged control system. During high fire (100% input), air is supplied to the fuel flow in the primary stage as that the primary stage $\phi$ 42 runs at a particular rich ratio 40 (typically about 1.4). Additional air is added in the secondary stage so as to establish an overall burner $\phi$ 44 that is less than one, i.e. about 10% excess air ($\phi=0.909$). During thermal turndown, the fuel supply 18 is lowered from 100% at a rate faster than the air supply 12. Since the proportion of air flow to each stage is fixed, the primary stage $\phi$ 42 decreases in proportion with the overall burner $\phi$ 44. At some point 46 during turndown, the primary stage will cross the stoichiometric ratio. At that point, the secondary stage is merely adding excess air and thus the benefits of staged combustion are lost.

FIG. 2B illustrates the change in $\phi$ as a function of burner input during thermal turndown for a typical premixed fuel-staged control system. (Of course, the systems described herein can also be nozzle-mixed systems. During high fire (100% input), fuel is supplied to the air flow in the primary stage so that the primary stage $\phi$ 52 runs at a particular lean ratio 50 (typically about 0.6) which is above the lean limit. Additional fuel is added in the secondary stage so as to establish an overall burner $\phi$ 54 that is less than one, i.e. about 10% excess air ($\phi$=0.909). During thermal turndown, the fuel supply 18 is lowered from 100% at a rate faster than the air supply 12. Since the proportion of air flow to each stage is fixed, the primary stage $\phi$ 52 decreases in proportion with the overall burner $\phi$ 54. At some point 56 during turndown, the primary stage will cross the lean flammability limit for a premixed system, at which point the burner flame is extinguished. In view of these operational problems, the fixed reactant delivery through the limiting orifices of previous systems does not provide reliably effective thermal turndown.

There are several factors that also influence thermal input in previous systems even under constant firing with fixed reactant flows defined by the limiting orifices 30, 32. Air and fuel composition can vary over time, affecting the effective equivalence ratio. For example, cold air is more dense than hot air, and thus hot air has less oxygen per unit volume than cold air supplied at a comparable pressure. Hot air thus makes the burner fire rich. Some burner systems are operated under desert conditions where air temperatures can vary as much as 100° F from night to day. Also, some systems use preheated air which may be quite hot and thus considerably less dense. Thus, air temperature can affect the equivalence ratio. Humidity can also affect the equivalence ratio since humid air has less oxygen content than dry air for a given volume, temperature and pressure. Thus, humid air also makes the burner fire rich.

Fuel composition can also vary over time, thus affecting the equivalence ratio. Natural gas supplies are derived from various sources and the calorific value of utility supply natural gas can vary by as much as 10% over time. Since most common burner systems use utility gas, the burner can vary between rich or lean firing depending on the composition of the fuel supply. Since the previous systems are limited to fixed reactant flows, none can compensate for the variations in the composition of air and fuel.

FIG. 3 illustrates a curve of optimal performance for a staged burner during preheated air operation. As preheated air temperature (T) is increased, the equivalence ratio $\phi$ in the primary stage must be decreased in order to maintain the optimum firing ratio 60. NOx production becomes a problem if the primary stage is operated at an equivalence ratio which is too high for a given thermal input. If the equivalence ratio is held constant with increasing preheat temperature, the mixture will fire rich, thereby increasing NOx production. Above a certain rich limit 62, the firing conditions 66 are such as will produce unacceptably high NOx.

As also seen in FIG. 3, if the primary equivalence ratio is held constant with decreasing air preheating, the mixture fires more lean, producing an unstable, inefficient flame, and possibly crossing the premix lean flammability limit 64 into conditions of flame extinction 68. Under these conditions, no flame occurs in the primary stage and the burner is shut down by the flame monitoring systems typically used with such burners.

As seen from FIG. 3, there is a narrow window of desirable operating conditions for variable air preheat conditions in a staged burner. However, previous systems are limited by fixed reactant flow proportions and are typically varied manually. It is not uncommon to operate staged burners at conditions which are not optimal or even acceptable. Thus, the previous systems do not offer adequate control over the equivalence ratios while using preheated air, thereby sacrificing the benefits of staged systems and producing unacceptable emission levels.

Another method often used with previous systems for controlling NOx production is Flue Gas Recirculation (FGR). With this technique, a portion of the burnt effluent from the burner output is drawn back and mixed with the air flow 12. FGR effects the energy balance of the burner, since recirculated flue gas, as an inert diluent, acts as an additional thermal load, thus lowering the temperature of the burner flame. The flame temperature is suppressed by an amount related to the percentage of flue gas recirculated into the air flow 12. Since flame temperatures are thereby suppressed, NOx emission are lowered.

While lowering NOx emissions, FGR tends to increase the lean flammability limit, thus driving up the equivalence ratio of the primary stage. FIG. 4 illustrates the variation in the equivalence ratio of the primary stage as a function of FGR, where FGR is measured as the ratio of FGR flow to combustion air flow. As FGR is increased, the equivalence ratio $\phi$ increases following an optimum firing ratio 80. If $\phi$ does not change with decreasing FGR, an operational limit 82 is reached, beyond which are conditions 86 of unacceptable NOx production. If $\phi$ does not change with increasing FGR, a lean limit 84 is reached, beyond which are conditions 88 of flame extinction. As is true with preheated air operation, the previous systems do not offer adequate control of the equivalence ratios for fluctuating conditions of FGR.

SUMMARY OF THE INVENTION

In view of the above-noted disadvantages encountered in previous systems, it is therefore an object of the present invention to provide a staged burner control which produces an adaptable thermal profile in response to varying turndown requirements.

It is another object of the present invention to provide a staged burner control which adapts the burner output in response to variable input conditions.

It is a further object of the present invention to provide a staged burner control which produces minimal NOx and CO emissions in a staged system.

It is another further object of the present invention to provide a staged burner with increased stability in order to reduce operational failures.

The objects of the present invention are satisfied by the present method and apparatus for controlling a staged combustion system. In the method of the present invention, at least a first reactant is supplied to a burner, wherein said reactant is supplied as at least a primary flow and a secondary flow. A second reactant is then flowed into the primary flow and combusted to produce a primary combustion stage. Independent control is established over the respective primary flow and second reactant flow so that the primary combustion stage has a primary predetermined equivalence ratio.

The combusted products of the primary combustion stage are flowed into the secondary flow to produce a secondary combustion stage. Independent control is established over the secondary flow so that the primary and secondary combustion stages have an overall predetermined equivalence ratio. The respective flows of the first reactant and second reactant are then varied so that the respective predetermined equivalence ratios are maintained by the respective independent controls.

The above and other objects of the invention will become apparent from consideration of the following detailed description of the invention as is particularly illustrated in the accompanying drawings.

DETAILED DESCRIPTION OF THE PREFERRED EMBODIMENT

The present staged combustion system solves the problems of such previous systems by providing a staged combustion system in which independent control is maintained over each of the respective flows of both the primary and secondary stages. By controlling the reactant flows to the primary and secondary stages, the equivalence ratio for the primary stage and the overall burner can be controlled so as to maintain optimal burner firing at each point during turndown and also in response to fluctuations in the FGR rate and preheated air temperature. With the control system of the present invention, the reactant flows can also be controlled so as to vary the equivalence ratio in response to variations in air temperature and composition, humidity, fuel composition and the like in order to maintain optimum firing conditions under variable input conditions.

Figure 1:
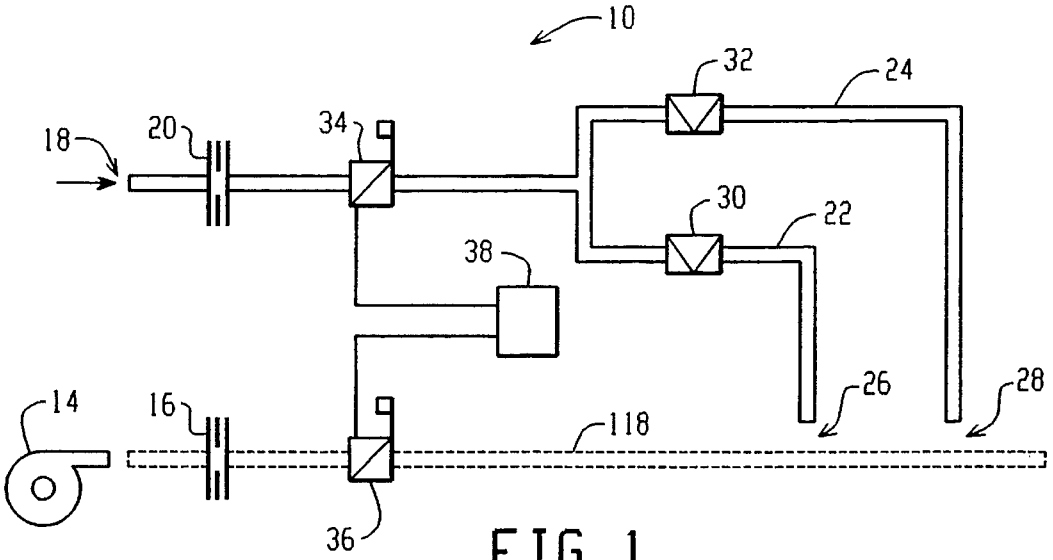
FIG. 1 PRIOR ART
FIG. 1 is a schematic drawing illustrating a staged burner such as is commonly provided by previous systems.
Figure 5:
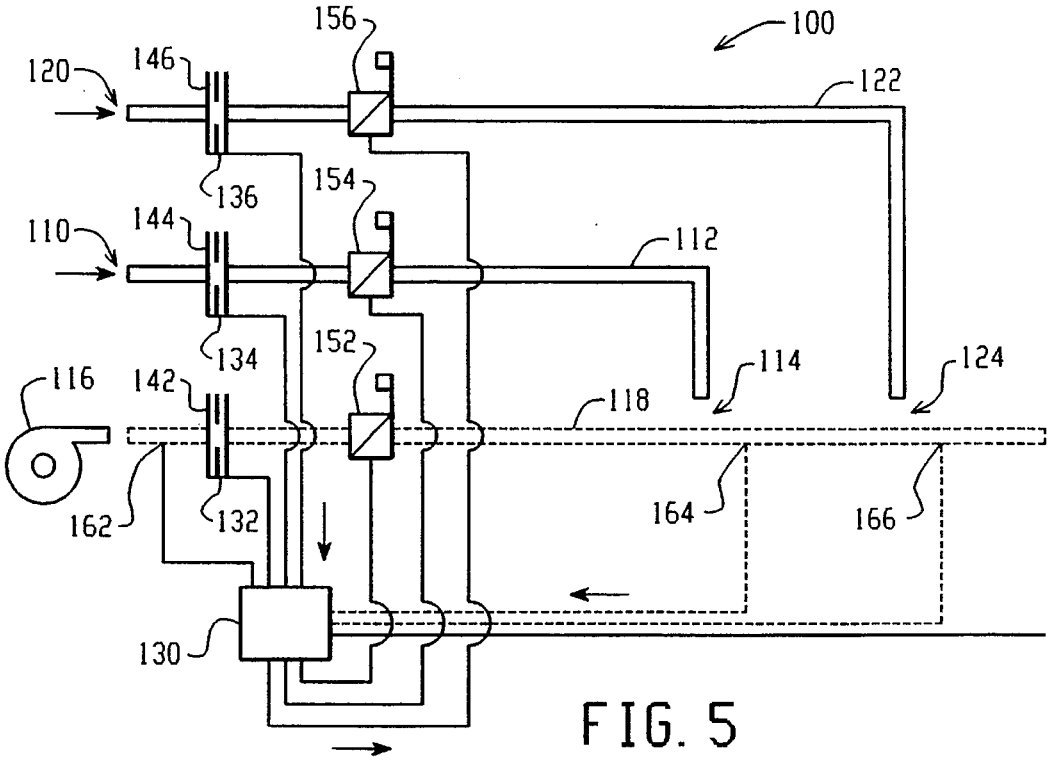
FIG. 5 is a schematic drawing illustrating the staged burner having independent control over the staged reactant, in accordance with the present invention.

FIG. 5 shows the preferred embodiment of the staged combustion system 100 of the present invention. The embodiment shown, for illustrative purposes, is a fuel-staged system. However, the embodiment could just as easily be configured as an air-staged system without departing from the invention. In the illustrated embodiment, a fuel supply 110 supplies fuel along a primary fuel flow 112 to the primary combustion stage 114. Similarly, a fuel supply 120 supplies fuel along a secondary fuel flow 122 to the secondary combustion stage 124. The respective fuel supplies 110, 120 may be the same fuel supply or different respective fuel supplies, supplying either the same or different fuel. Air is supplied to the burner by a blower 116 along a path of air flow 118. The air and primary fuel flow 112 are combusted in the primary combustion stage 114 and the burnt effluent from the primary stage 114 is mixed with the second fuel flow 122 at the secondary stage 124.

The primary fuel flow 112, the second fuel flow 122 and the air flow 118 are all regulated by a control system 130 which determines the flows needed to maintain the proper equivalence ratios at each stage. The control system 130 receives signals from respective pressure transducers 132, 134, 136 which measure the pressure differentials across respective orifice plates 142, 144, 146 which are in line with each respective flow 112, 118, 122. Pressure differentials are directly related to volume flow rates according to the known principles and laws of fluid mechanics. Therefore, the pressure transducers 132, 134, 136 provide the control system 130 with direct information about the respective flows of the two reactants. (In the preferred embodiment, the transducers are North American 8245.) Of course, other types of flow sensors could also be used to obtain flow data, such as a thermal anemometer or a valve position sensor.

The control system 130 receives the pressure differential signals and generates respective control signals which operate respective motorized flow control devices, preferably valves 152, 154, 156 which vary the respective flows of the two reactants. The valves 152, 154, 156 respond to the control system 130 in order to vary the rate of flow through the valves as a function of transducer feedback. Thus, the control system 130 can variably control the rates of reactant flow to the burner in order to establish and maintain desired equivalence ratios for all firing conditions.

While the preferred embodiment shows three reactant flows combustion in a two-stage burner, the present control system 130 can just as easily be used to control more than three reactant flows, and can additionally be used to control a burner with more than two stages.

The control system 130 regulates the flows to each stage in response to various primary zone variables. In this way, the present invention provides a degree of control over the primary and secondary stages that was not attainable with previous systems. The calculated energy output from the inputted reactants can be used as a primary zone variable to control burner firing. By monitoring and controlling the respective flows, the calculated thermal energy output of the burner at each stage can be predicted from known physical relationships. Thus, the equivalence ratios of the primary stage and the overall burner can be predicted so as to provide a calculated rate of combustion from which follows a desired thermal profile.

In addition, the respective flows can be varied between stages to produce a desired calculated flame temperature, since such a value can also be predicted from known physical relationships. The control system 130 can include calculational algorithms or tabulated data for comparing sensor data to obtain such an operational result. With the present invention, the thermal output and flame temperature of a staged burner can be varied over the course of a given combustion process or from process to process. The equivalence ratios $\phi$ for both the primary stage and the overall burner can also be varied at any point in the process so as to produce optimal control over the combustion conditions and the thermal profile. The calculational algorithms or tabulated data can be used to adjust the target equivalence ratios for a desired optimal combustion result.

The present invention also offers adaptable control over the primary stage equivalence ratio and also the overall equivalence ratio in response to fluctuating system demands. The control system 130 can also vary reactant flows according to mixing schemes other than the commonly used equivalence ratios. As turndown is required in a furnace environment, the control system 130 can vary the reactant flows in order to maintain an optimum equivalence ratio in the primary stage for a given thermal input, thus insuring efficient firing with significant NOx control.

Figure 2A:
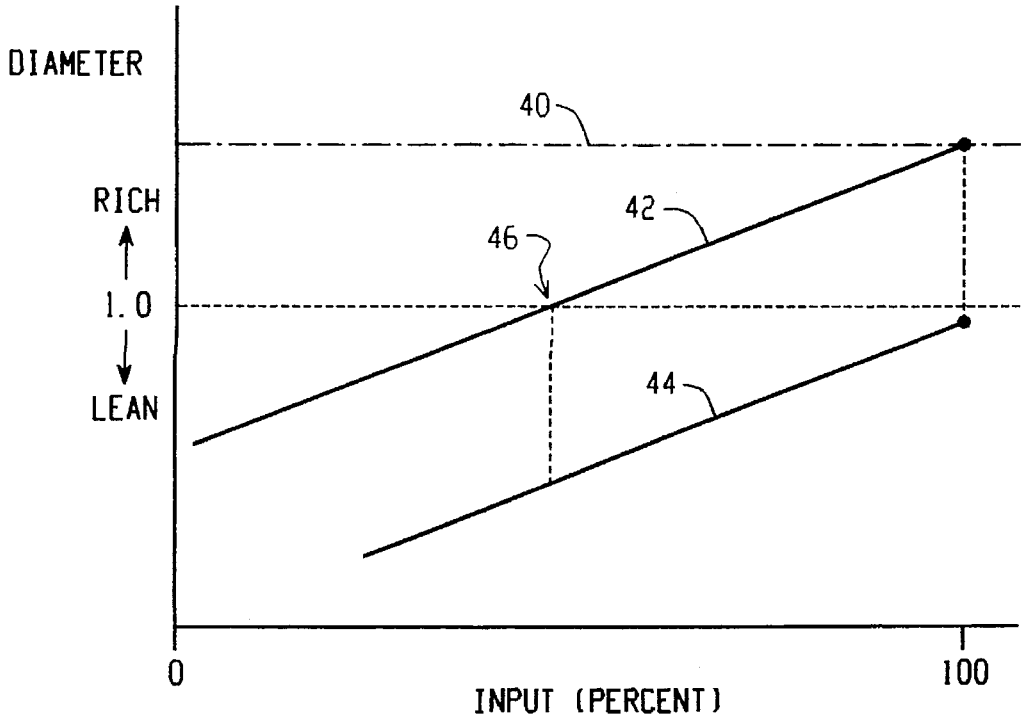
FIGS. 2A and 2B are graphs respectively illustrating the variation in equivalence ratios in the primary stage to the overall system as a function of thermal input for air-staged and fuel-staged burners.
Figure 2B:
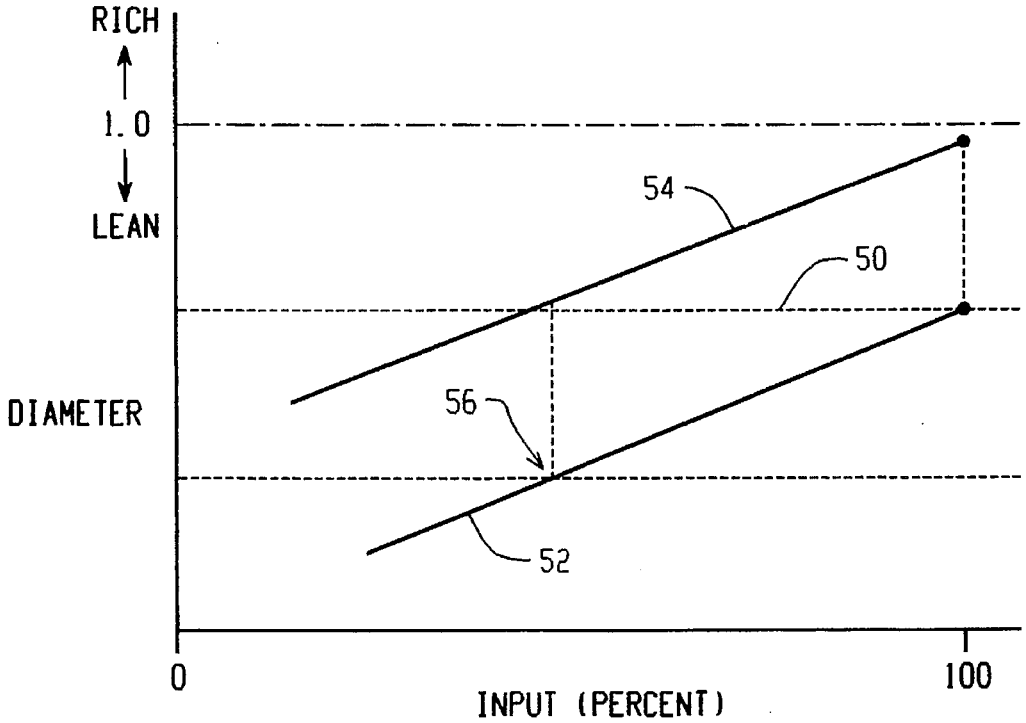
Figure 3:
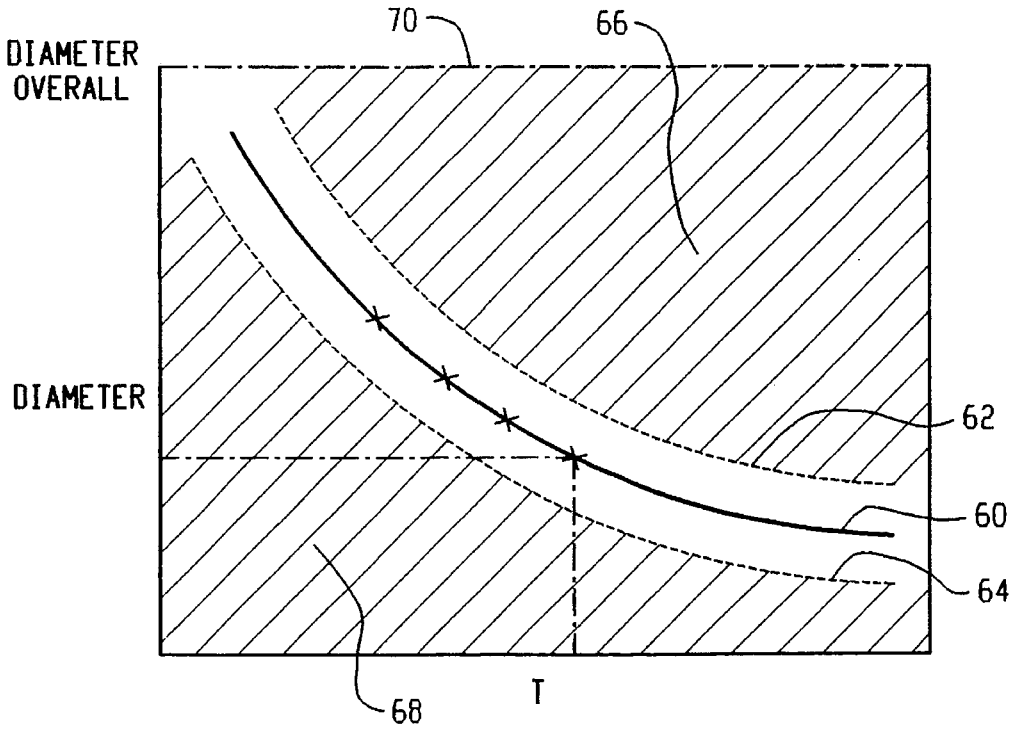
FIG. 3 is a graph illustrating the variation in equivalence ratios in the primary stage of a staged burner as a function of air temperature for preheated air burners.
Figure 4:
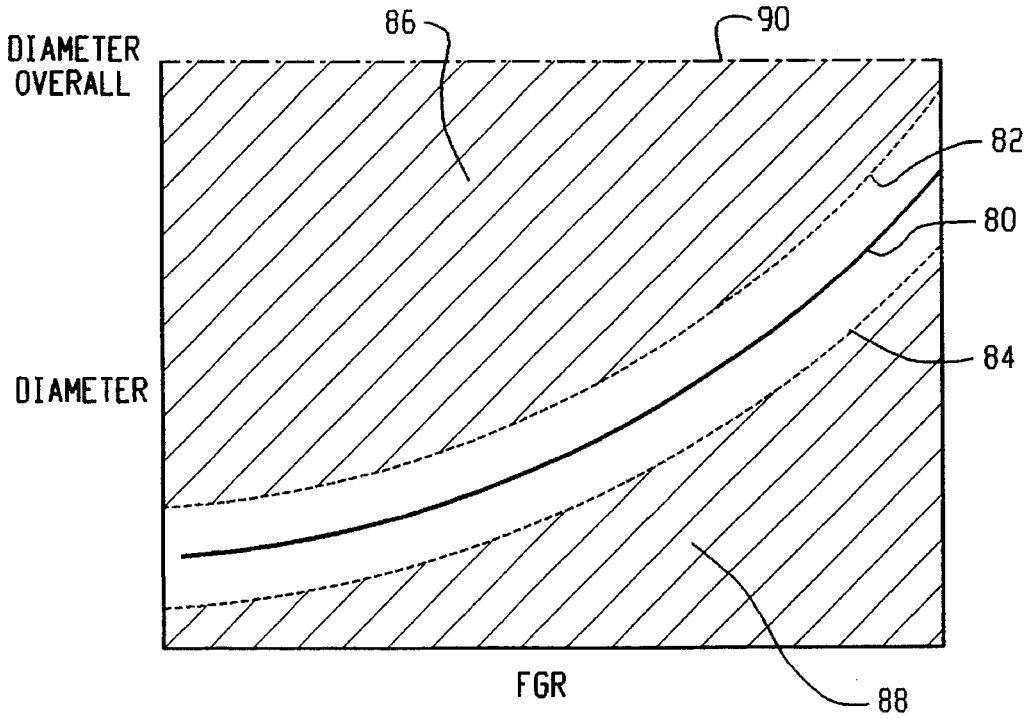
FIG. 4 is a graph illustrating the variation in equivalence ratios in the primary stage of a staged burner as a function of flue gas recirculation.

For example, referring to FIGS. 2A and 2B, in an air-staged system, the primary stage $\phi$ can be maintained constant for the rich ratio 40, representing the $\phi$ of 100% high fire, so as to preserve the benefits of staged burners. Similarly, in a fuel-staged system, the primary stage $\phi$ can be maintained constant for the lean ratio 50, representing the $\phi$ of 100% high fire, so as to preclude the extinguishing of the flame. In this way, the present invention offers significantly greater control over staged burners than that available with previous systems.

The present invention also offers adaptable control over primary stage firing in response to a fluctuating FGR rate. In the event that the FGR rate increases or decreases, the control system 130 can adjust the flows to maintain an optimum equivalence ratio in the primary stage. In this way, the present invention offers adaptable control over firing conditions in response to changing system demands and input conditions. Such control, in both the primary stage and the overall burner, has not been found in previous systems.

Other variables can be measured and used by the control system 130 to control the respective flows to the burner. For example, one or more sensors 162 can be placed upstream of the primary combustion stage to measure changes in oxygen content due to variations in air temperature, air composition, flue gas recirculation and humidity within the air flow 118, thus providing a "feed forward" control over the primary combustion stage. These sensors 162 can be used to detect such variations and communicate this information to the control unit 130. The control unit 130 uses the sensor input as a measured variable to adjust respective valve positions in order to compensate for variations in the oxygen content of the air and thereby maintain the desired rate of combustion in accordance with known principles for determining dependence upon such variables. Similarly, a sensor (e.g. a gas chromatograph) could also be used to detect similar variations and fluctuations in the composition of the fuel flow in order to vary the rates of reactant flow to a desired proportion. Other sensors can also be used to measure other variables which can affect the firing of a burner.

The present burner may also include one or more primary stage sensors 164 and one or more secondary stage sensors 166. These sensors could optionally be used to measure the temperature of the primary stage or other parameters such as emissions levels in order to vary the rates of reactant flow. For example, the sensors 164, 166 could measure NOx emission levels, or products of partial combustion such as carbon monoxide (CO). Further, the oxygen level could be measured to indicate an undesirable excess air condition, and thus provide a "feed back" control over the primary combustion stage. In any case, a desired parameter can be measured in either the primary or the secondary stage, or in both stages. This parameter is then detected by the control unit 130 which then varies the respective reactant flows in order to drive the parameter toward a desired level. (In the case of NOx and other emissions, the measured parameter is used by the control unit 130 to drive the emissions toward the minimum possible level.) In this way, the present invention offers improved control over NOx emissions without generating additional CO emissions.

The present invention permits the modulation of gas flow between the primary and secondary stages of a staged burner. In this way, the control over the burner permits optimized burner operation, allowing combustion to be performed more efficiently and with lower levels of emissions and pollutants. By optimizing and controlling heat release, the present staged burner permits an adaptable control over the thermal profile of the burner output in response to variable input conditions while offering greater fuel efficiency and lower NOx and CO emissions than was possible with previous systems.

The foregoing description of the preferred embodiment has been presented for purposes of illustration and description. It is not intended to be limiting insofar as to exclude other modifications and variations such as would occur to those skilled in the art. Any modifications such as would occur to those skilled in the art in view of the above teachings are contemplated as being within the scope of the invention as defined by the appended claims.

What is claimed:

1. A method of controlling a staged combustion system comprising the steps of:

a) supplying a flow of at least a first reactant to a burner, wherein said reactant is supplied as at least a primary flow and a secondary flow;

b) flowing at least a second reactant into the primary flow and combusting to produce a primary combustion stage;

c) measuring the rates of the respective flows of said reactants to produce respective primary flow and second reactant flow signals;

d) establishing independent control over the respective primary flow and second reactant flow in response to said respective flow signals so that the primary combustion stage has a primary predetermined equivalence ratio;

e) flowing the combusted products of the primary combustion stage into the secondary flow to produce a secondary combustion stage;

f) measuring the rate of the secondary flow to produce a secondary flow signal;

g) establishing independent control over the secondary flow in response to the secondary flow signal so that the primary and secondary combustion stages have an overall predetermined equivalence ratio; and h) varying the respective flows of the first reactant and second reactant wherein the respective predetermined equivalence ratios are maintained by the respective independent controls in response to the respective flow signals.

2. A method of controlling a staged combustion system comprising the steps of:

a) supplying a flow of at least a first reactant to a burner, wherein said reactant is supplied as at least a primary flow and a secondary flow;

b) flowing at least a second reactant into the primary flow and combusting to produce a primary combustion stage;

c) establishing independent control over the respective primary flow and second reactant flow so that the primary combustion stage has a primary predetermined equivalence ratio;

d) flowing the combusted products of the primary combustion stage into the secondary flow to produce a secondary combustion stage;

e) establishing independent control over the secondary flow so that the primary and secondary combustion stages have an overall predetermined equivalence ratio;

f) measuring at least one predetermined process variable to establish at least one burner control signal; and g) varying the respective flows of the first reactant and second reactant wherein the respective predetermined equivalence ratios are maintained by the respective independent controls in response to the at least one burner control signal; and h) adjusting the reactant flows between variable firing conditions in order to maintain a reactant balance ratio which provides a desired combustion result.

3. The method of claim 2 wherein the predetermined process variable is measured upstream of the primary combustion stage.

4. The method of claim 2 wherein the reactants are fuel and oxidant and the measured predetermined variable is oxidant temperature.

5. The method of claim 2 wherein the reactants are fuel and an air/FGR mixture and the measured predetermined variable is FGR flow rate.

6. The method of claim 2 wherein the reactants are fuel and air and the measured predetermined variable is fuel composition.

7. The method of claim 2 wherein the predetermined process variable is measured within the primary combustion stage.

8. The method of claim 7 wherein the reactants are fuel and the measured predetermined variable is a primary combustion stage product constituent selected from the group consisting of $O_2$, $CO_2$, CO and $NO_x$.

9. The method of claim 7 wherein the measured predetermined variable is primary stage temperature.

10. The method of claim 2 wherein the predetermined process variable is measured downstream of the primary combustion stage.

11. The method of claim 10 wherein the reactants are fuel and oxidant and the measured predetermined variable is an overall product constituent selected from the group consisting of $O_2$, $CO_2$, CO and $NO_x$.

12. The method of claim 2 wherein the measured predetermined variable is thermal profile.

13. The method of claim 1 wherein the first reactant is air so as to define an air-staged system.

14. The method of claim 1 wherein the first reactant is fuel so as to define a fuel-staged system.

15. A staged combustion system comprising:

a supply for a first reactant to a burner, wherein said supply includes a primary supply and a secondary supply;

a supply for a second reactant wherein said second reactant supply is reacted with the primary supply in a primary combustion zone;

a first variably controlled valve for controlling the primary supply and a second variably controlled valve for controlling the second reactant supply so that the primary combustion zone has a primary predetermined equivalence ratio;

a secondary combustion zone for receiving the combusted products of the primary combustion zone and the secondary supply to produce secondary combustion;

a third variably controlled valve for controlling secondary supply so that the primary and secondary combustion zones have an overall predetermined equivalence ratio; and at least one process control sensor for measuring least one predetermined burner variable to establish at least one burner control signal;

a control system for varying the respective valves in response to the at least one burner, control signal so that the flows of the first reactant and second reactant maintain the respective predetermined equivalence ratios, wherein said control systems adjusts the reactant flows between variable firing conditions in order to maintain a reactant balance ratio which provides a desired combustion result.

16. A staged combustion system comprising:

a supply for a first reactant to a burner, wherein said supply includes a primary supply and a secondary supply;

a supply for a second reactant wherein said second reactant supply is reacted with the primary supply in a primary combustion zone;

a first variably controlled valve for controlling the primary supply and a second variably controlled valve for controlling the second reactant supply so that the primary combustion zone has a primary predetermined equivalence ratio;

first and second flow sensors for measuring the rates of the respective flows of said reactants to produce respective primary supply and second reactant supply signals;

a secondary combustion zone for receiving the combusted products of the primary combustion zone and the secondary supply to produce secondary combustion;

a third variably controlled valve for controlling the secondary supply so that the primary and secondary combustion zones have an overall predetermined equivalence ratio; and a third flow sensor for measuring the rate of flow from the secondary supply to produce a secondary supply signal;

a control system for varying the respective valves in response to the respective supply signals so that the flows of the first reactant and second reactant maintain the respective predetermined equivalence ratios.

17. The staged combustion system of claim 16 wherein the first reactant is air so as to define an air-staged system.

18. The staged combustion system of claim 16 wherein first reactant is fuel so as to define a fuel-staged system.

* * * * *